US008303131B2

(12) United States Patent
Xue

(10) Patent No.: US 8,303,131 B2
(45) Date of Patent: Nov. 6, 2012

(54) DETACHABLE LED LIGHTING LAMP

(76) Inventor: Xinshen Xue, Shenzhen (CN)

( * ) Notice: Subject to any disclaimer, the term of this patent is extended or adjusted under 35 U.S.C. 154(b) by 394 days.

(21) Appl. No.: 12/783,102

(22) Filed: May 19, 2010

(65) Prior Publication Data

US 2011/0140631 A1 Jun. 16, 2011

(30) Foreign Application Priority Data

Dec. 11, 2009 (CN) ..... 2009 1 0188787

(51) Int. Cl.

| | |
|---|---|
| ***F21L 4/00*** | (2006.01) |
| *F21V 19/00* | (2006.01) |
| *F21V 21/00* | (2006.01) |
| *F21S 8/08* | (2006.01) |

(52) U.S. Cl. ..... 362/157; 362/382; 362/410

(58) Field of Classification Search ..... None
See application file for complete search history.

(56) References Cited

U.S. PATENT DOCUMENTS

| | | | | |
|---|---|---|---|---|
| 7,556,398 | B2 * | 7/2009 | Van Der Poel | 362/227 |
| 2011/0261583 | A1 * | 10/2011 | Geuder et al. | 362/555 |

* cited by examiner

*Primary Examiner* — Douglas W Owens
*Assistant Examiner* — Dedei K Hammond
(74) *Attorney, Agent, or Firm* — Hamre, Schumann, Mueller & Larson, P.C.

(57) ABSTRACT

A detachable LED lighting lamp includes a light source having a light source body and a light head integrally connected with the light source body; a lamp holder having a light source stand and a power supply socket disposed at a bottom end of the light source stand; and a power supply having a power source body, a plug fixedly connected with an upper end of the power source body, and an electrical wire connected with a bottom end of the power source body. The power supply further has a drive power supply disposed therein. The light head matches with the light source stand in shape, the power supply socket matches with the plug in shape.

9 Claims, 4 Drawing Sheets

DETACHABLE LED LIGHTING LAMP

TECHNICAL FIELD

The present invention relates to LED lighting devices, and more particularly, to a detachable LED lighting lamp.

BACKGROUND

Under the circumstance of the shortage of energy, energy saving gets more and more important in the modern society, and most of the countries in the world advocate energy saving and waste gas emission reduction, therefore, an LED is widely used due to advantages of energy saving, long service life, environment protection, etc. The meanings of the popularization of a white light LED lighting lamp is greatly significant, however, in order to be widely used in the world, there is a major breakthrough in technology and price for the LED lighting lamp, namely, the luminous efficiency reaches 120-150 lm/W and the price is lower than that of the conventional LED lighting lamp at 8-10 times. An LED light source in the conventional LED lighting lamp is connected with a power source in a light head through a conducting wire and is connected with a light board by heat conducting paste. The conventional LED lighting lamp has a lot of deficiencies in that its manufacturing process is complex, it is inconvenient to use, and it must be used together with a special light holder. The heat generated from the conventional LED lighting lamp can not be emitted completely, thereby causing a drive circuit or the LED to burn and reducing service life of the lighting lamp.

There is, therefore, a need for a detachable LED lighting lamp, which solves the problems of dissipating heat and inconvenient use.

SUMMARY

In order to overcome the above-mentioned shortcomings of the heat dissipating and inconvenient use of the conventional LED lighting lamp, the present patent application provides a detachable LED lighting lamp.

The technical solution of the present patent application is described as follow:

A detachable LED lighting lamp includes a light source having a light source body and a light head integrally connected with the light source body; a lamp holder having a light source stand and a power supply socket disposed at a bottom end of the light source stand; and a power supply having a power source body, a plug fixedly connected with an upper end of the power source body, and an electrical wire connected with a bottom end of the power source body. Wherein the power supply further has a drive power supply disposed therein, and the light head matches with the light source stand in shape, the power supply socket matches with the plug in shape.

Preferably, the light head includes an electricity coupling part and a contacting part which is integrally connected with the electricity coupling part.

Preferably, the electricity coupling part is formed to have a connection structure which is a bayonet coupling structure or a threaded connection structure.

Preferably, the light source is tightly coupled to the lamp holder through threads formed on the contacting part.

Preferably, the power supply is disposed in the lamp holder or on an outer portion of the lamp holder.

Preferably, the lamp holder is made from ceramics, plastics or resin material.

Preferably, the light source and the power supply are detachable when the lamp holder is fixed.

Preferably, the light source is an LED light source, and supply current is direct current having 12V or 24V.

Preferably, the light source is formed by at least one light source which is concolorous or multicolor.

The detachable LED lighting lamp has the following advantages: Firstly, the light head of the LED light source is closely connected with the lamp holder, therefore, the heat energy generated by the LED light source is rapidly conducted to the lamp holder, thereby enlarging heat dissipating area, effectively protecting the LED lighting lamp, and extending the service life of the lighting lamp. Secondly, the detachable LED lighting lamp has an exquisite structure and design, and can be designed to form various shapes according to requirement to be accordant with the aesthetic need with different levels. Meanwhile, the light source and power supply can be demounted from the light holder and replaced when the light holder is fixed. Thirdly, the detachable LED lighting lamp is convenient in use, and is made from a new environment-friendly material with high heat conduction and good insulating ability, thereby reducing use cost for consumers. Fourthly, the detachable LED lighting lamp employs an external power supply component to provide power to the LED lamp with wide voltage and constant current, thereby increasing luminous stability of the light. The power supply component can be demounted, thereby improving luminous quality and prolonging service life of the lighting lamp. Fifthly, according to requirement of the consumers, operators in a manufactory can select a large-power LED with different colors such as white, green, blue, and the like, to manufacture a detachable LED lighting lamp and create multiple visual effects.

Other objects, advantages and novel features of the present invention will become more apparent from the following detailed description when taken in conjunction with the accompanying drawings, in which:

DETAILED DESCRIPTION OF THE PREFERRED EMBODIMENTS

Figure 1:
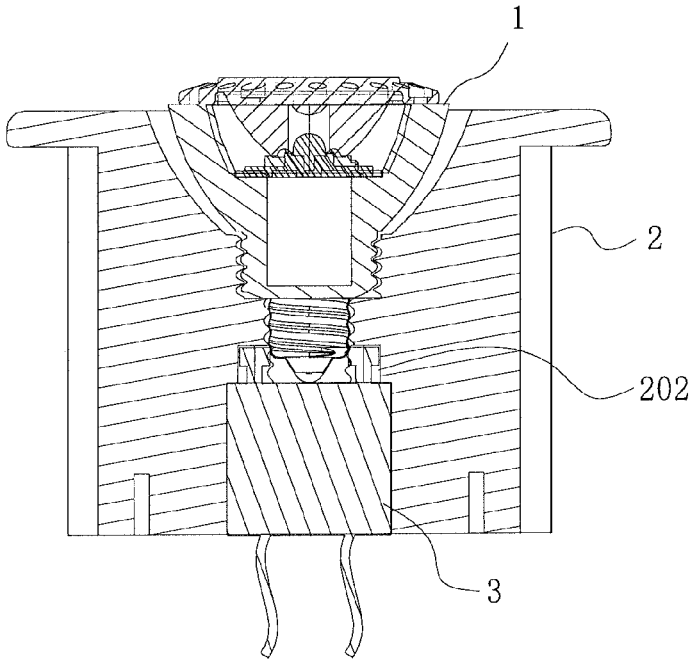
FIG. 1 is a sectional view of a detachable LED lighting lamp in accordance with a first embodiment in the present invention.
Figure 2:
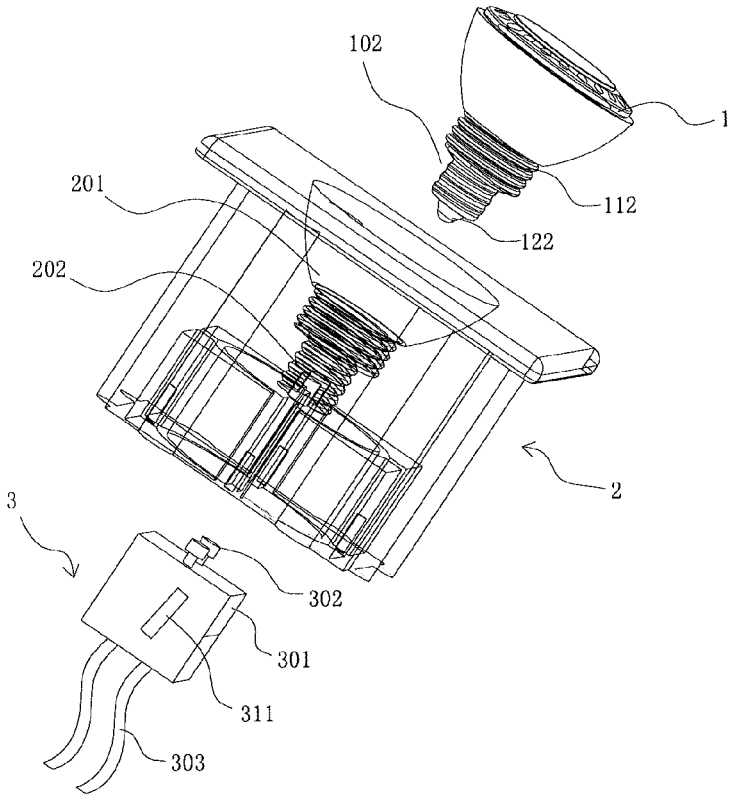
FIG. 2 is a structural view of the detachable LED lighting lamp in accordance with the first embodiment in the present invention.

Objects, advantages and embodiments of the present invention will be explained below in detail with reference to the accompanying drawings. However, it is to be appreciated that the following description of the embodiment(s) is merely exemplary in nature and is no way intended to limit the invention, its application, or uses.

Referring to FIG. 1, FIG. 2, FIG. 4 and FIG. 5, the detachable LED lighting lamp includes a light source 1, a lamp holder 2 and a power supply 3. The light source may be formed by one, two, or many light sources which is concolorous or multicolor light sources such as LEDs. The lamp holder 2 is made from a new insulating material with high heat conduction such as ceramics, plastics or resin, and so on. The light source 1 includes a light source body 101 and a light head 102 integrally connected with the light source body 101. The power supply 3 includes a power supply body 301, a plug 302 fixedly connected with an upper end of the power supply body 301, and an electrical wire 303 coupled with a bottom end of the power supply body 301. The lamp holder 2 is internally provided with a light source stand 201 and a power supply socket 202 disposed at a bottom end of the light source stand 201. The light head 102 matches with the light source stand 201 in shape. The power supply socket 202 matches with the plug 302 in shape. The light head 102 includes an electricity coupling part 112 and a contacting part 122 integrally connected with the electricity coupling part 112. The light source 1 and the power supply 3 can be demounted or mounted when the lamp holder 2 is fixed.

Figure 3:
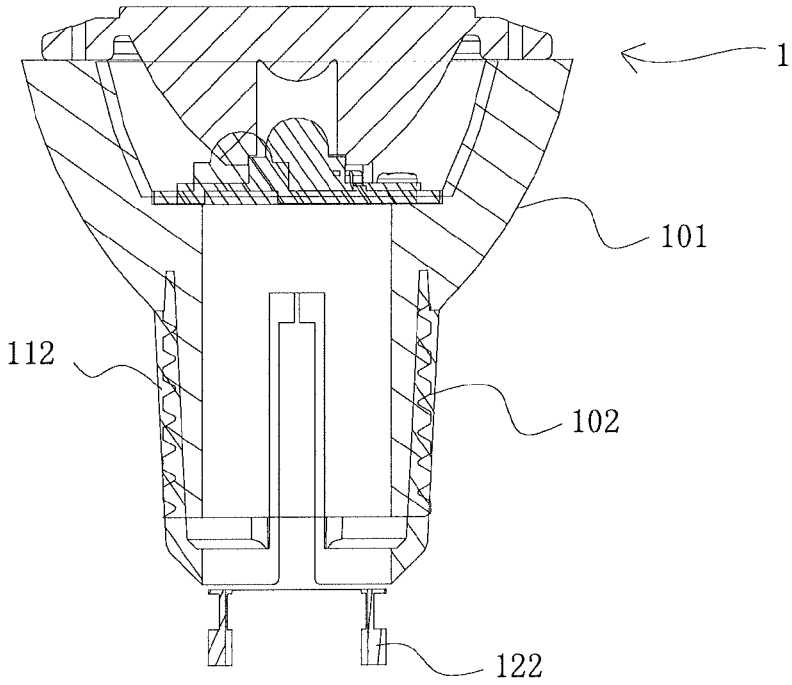
FIG. 3 is a structural view of a first light source in the first embodiment.
Figure 6:
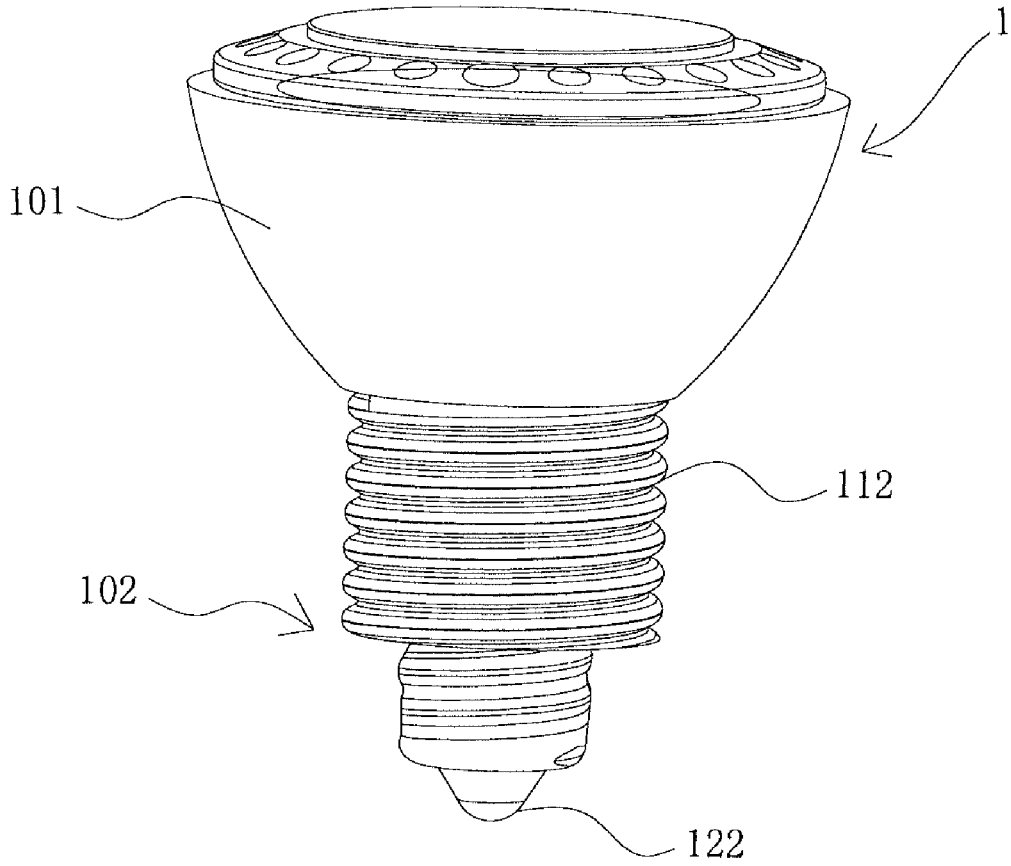
FIG. 6 is a structural view of a second light source in the second embodiment. Reference numerals: 1—light source, 101—light source body, 102—light head, 112—electricity coupling part, 122—contacting part, 2—lamp holder, 201—light source stand, 202—power supply socket, 3—power supply, 301—power supply body, 302—plug, 303—electrical wire.

Referring to FIG. 3 and FIG. 6, the electricity coupling part 112 is formed to have a connection structure which is a bayonet coupling structure or a threaded connection structure. A screw thread of the contacting part 122 is matched with a screw thread of the light source stand 201 in the lamp holder 2. By adopting the thread structure, heat energy generated from a light source component is easily conducted to the lamp holder, thereby enlarging heat dissipating area.

Figure 4:
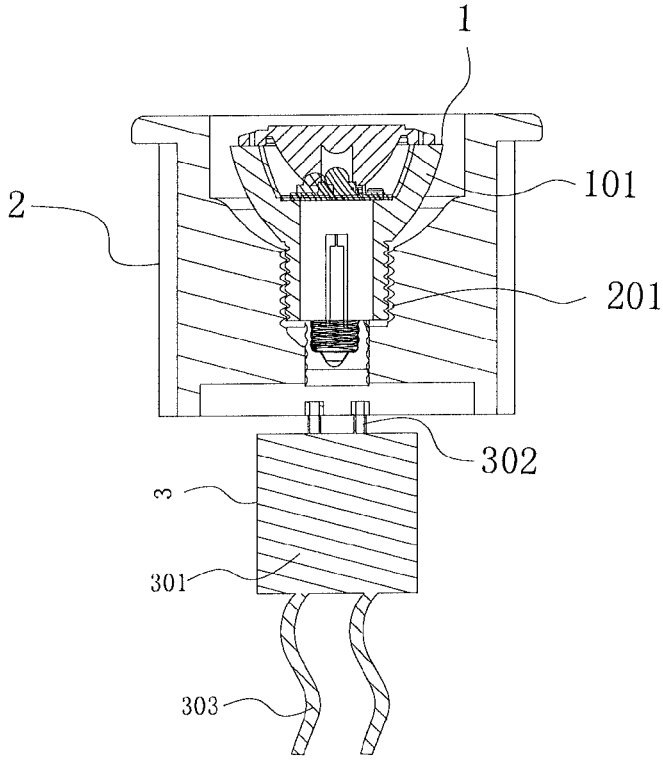
FIG. 4 is a sectional view of a detachable LED lighting lamp in accordance with a second embodiment in the present invention.
Figure 5:
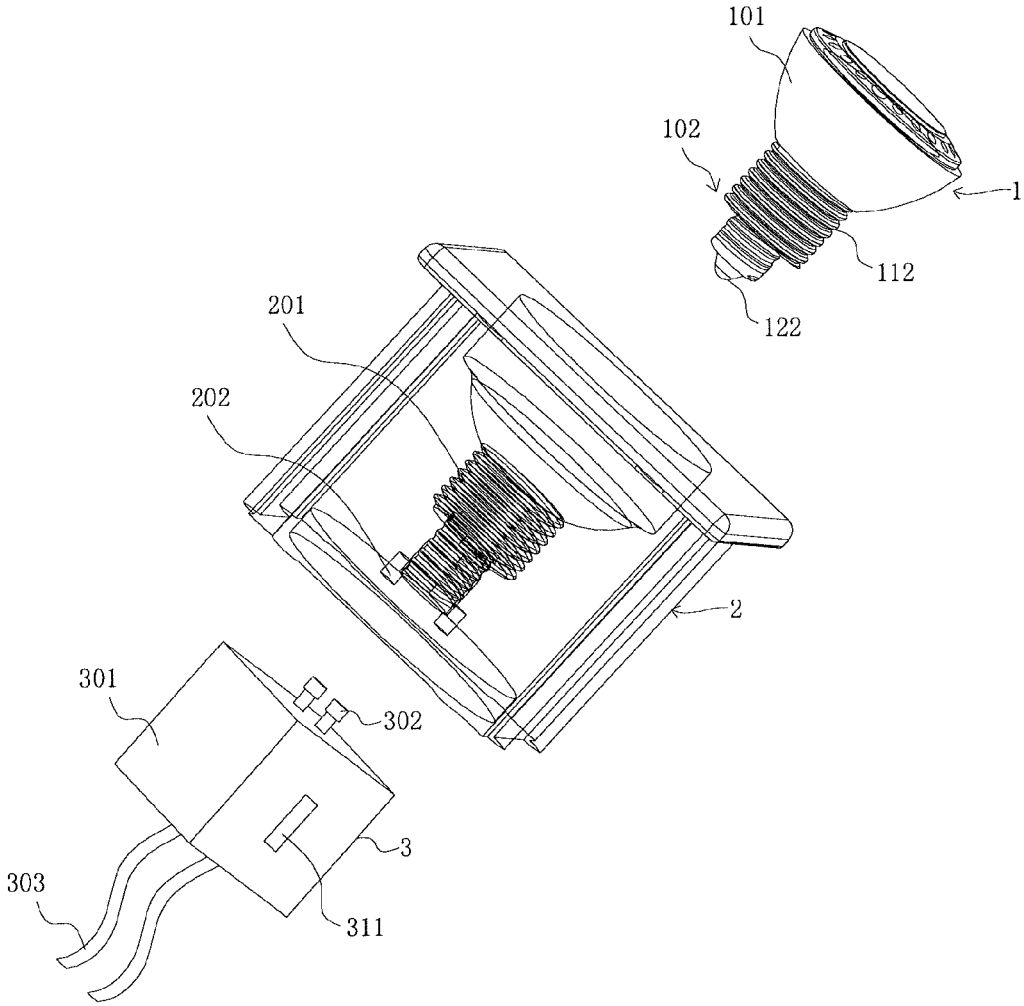
FIG. 5 is a structural view of the detachable LED lighting lamp in accordance with the second embodiment in the present invention.

Referring to FIG. 1 and FIG. 4, the power supply 3 may be disposed in an inner portion of the lamp holder 2 or on an outer portion of the lamp holder 2.

The working principle of the present invention is described as follow:

The detachable structure formed by the light source 1, the lamp holder 2 and the power supply 3 change the structure of the conventional lighting lamp, and it is convenient to detach. The drive power supply 311 disposed in the power supply 3 supplies DC having 12V or 24V for the light source 1 which is matched with the lamp holder 2. The contacting part 122 of the light head 102 is closely screwed with the lamp holder 2 by the connection structure, so that heat energy generated from the light source 1 is easily conducted to the lamp holder 2, thereby enlarging the heat dissipating area. The light source 1 is supplied power with wide voltage and constant current, thereby increasing luminous stability of the light source 1, and improving luminous quality and extending service life of the light source 1.

The present invention may be embodied in other forms without departing from the spirit or novel characteristics thereof. The embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. A detachable LED lighting lamp comprising: a light source having a light source body and a light head integrally connected with the light source body; a power supply having a power source body, a plug fixedly connected with an upper end of the power source body, and an electrical wire connected with a bottom end of the power source body, wherein the power supply further has a drive power supply disposed therein; and a lamp holder having a light source stand and a power supply socket disposed at a bottom end of the light source stand, wherein the light head matches with the light source stand in shape, the power supply socket matches with the plug in shape.

2. The detachable LED lighting lamp as claimed in claim 1, wherein the light head comprises an electricity coupling part and a contacting part which is integrally connected with the electricity coupling part.

3. The detachable LED lighting lamp as claimed in claim 2, wherein the electricity coupling part is formed to have a connection structure which is a bayonet coupling structure or a threaded connection structure.

4. The detachable LED lighting lamp as claimed in claim 3, wherein the light source is tightly coupled to the lamp holder through threads formed on the contacting part.

5. The detachable LED lighting lamp as claimed in claim 4, wherein the power supply is disposed in the lamp holder or on an outer portion of the lamp holder.

6. The detachable LED lighting lamp as claimed in claim 5, wherein the lamp holder is made from ceramics, plastics or resin material.

7. The detachable LED lighting lamp as claimed in claim 5, wherein the light source and the power supply are detachable when the lamp holder is fixed.

8. The detachable LED lighting lamp as claimed in claim 7, wherein the light source is an LED light source, and supply current is direct current having 12V or 24V.

9. The detachable LED lighting lamp as claimed in claim 8, wherein the light source is formed by at least one light source which is concolorous or multicolor.

* * * * *